United States Patent [19]

Wich

[11] 4,019,415

[45] Apr. 26, 1977

[54] KEY CUTTING MACHINE

[76] Inventor: Horst W. Wich, 816 Brent St., South Pasadena, Calif. 91030

[22] Filed: Sept. 22, 1975

[21] Appl. No.: 615,396

Related U.S. Application Data

[63] Continuation of Ser. No. 458,708, April 8, 1974, abandoned.

[52] U.S. Cl. ..... 83/413; 83/556; 83/560; 83/917

[51] Int. Cl.[2] ..... B26F 1/12

[58] Field of Search ..... 83/409, 413, 556, 560, 83/917

[56] References Cited

UNITED STATES PATENTS

| | | | |
|---|---|---|---|
| 1,615,020 | 1/1927 | Loehr et al. | 83/560 X |
| 1,764,828 | 6/1930 | Cotton | 83/560 X |

*Primary Examiner*—Travis S. McGehee

[57] ABSTRACT

A key cutting machine having key cutting means and characterized in that each actuation of the cutting means is automatically preceded by a fine positioning action which causes the key blank to be precisely positioned at its desired location relative to the cutting means, and is automatically followed by a coarse positioning action which causes the key blank to be approximately positioned at its next cutting location.

12 Claims, 12 Drawing Figures

KEY CUTTING MACHINE

RELATED APPLICATIONS

This application is a continuation of my prior copending application Ser. No. 458,708 filed Apr. 8, 1974 and abandoned subsequent to the filing of this application.

My copending application Ser. No. 591,639 filed June 30, 1975, now Pat. No. 3,971,278 describes and claims the carriage positioning mechanism which was disclosed in said application Ser. No. 458,708, now abandoned and is also disclosed in this application.

BACKGROUND OF THE INVENTION

In the general usage of locks and keys by the public, it often happens that a new or additional key is needed, but expensive machines and skilled personnel are not available for that purpose. In some instances the new key is to be made as a copy of an old one. In other instances the new key is to be made according to "code"; that is, at the standard notch locations along the length of the key blank the various notches are to be cut to depths indicated by numbers 0, 1, 2, 3, 4, etc. The "code" for the key may be obtained by making measurements on an old key, or by analysis of the lock, or based on information obtained from the manufacturer of the lock and key.

Extra keys needed by the retain customer are generally made at locksmith shops, retail hardware stores, and other similar locations. It would be highly advantageous to have an inexpensive but effective machine for this purpose. The key cutting machine should not only be inexpensive as to its initial cost and precise and reliable in its operation, but it should also be adapted for operation by relatively unskilled personnel and should be relatively maintenance-free.

The present invention relates primarily to a machine for the coded cutting of keys. There is no single industry standard for coded keys, and hence the keys of different manufacturers have a different standard distance from the shoulder of the key to the first notch location, a different standard distance between notch locations, and different standard increments of depth for cutting the notches. Furthermore, in some code keys the notch locations are measured from the top end of the key blank rather than from the shoulder.

SUMMARY OF THE INVENTION

According to the present invention the positioning of the key blank relative to the cutting means is accomplished by the same control mechanism which actuates the cutting means itself. More specifically, the positioning of the key blank is done first by a coarse positioning action and thereafter by a fine positioning action. According to my invention the control mechanism for actuating the cutting means first actuates the fine positioning means so as to provide a precisely correct position of the key blank, then actuates the cutting means, and thereafter actuates the coarse positioning mechanism so that the key blank is approximately located at its next cutting location.

According to another feature of the invention the specific mechanisms for positioning and cutting the key blank are removable from the frame of the machine, and may be replaced with other similar parts in which the parameters are selected to conform to those of a different standard key. It is therefore possible to use a single machine for cutting various standard keys such as Schlage and Kwik-Set, amongst others.

DRAWING SUMMARY

PREFERRED EMBODIMENT

Figures 1, 12:
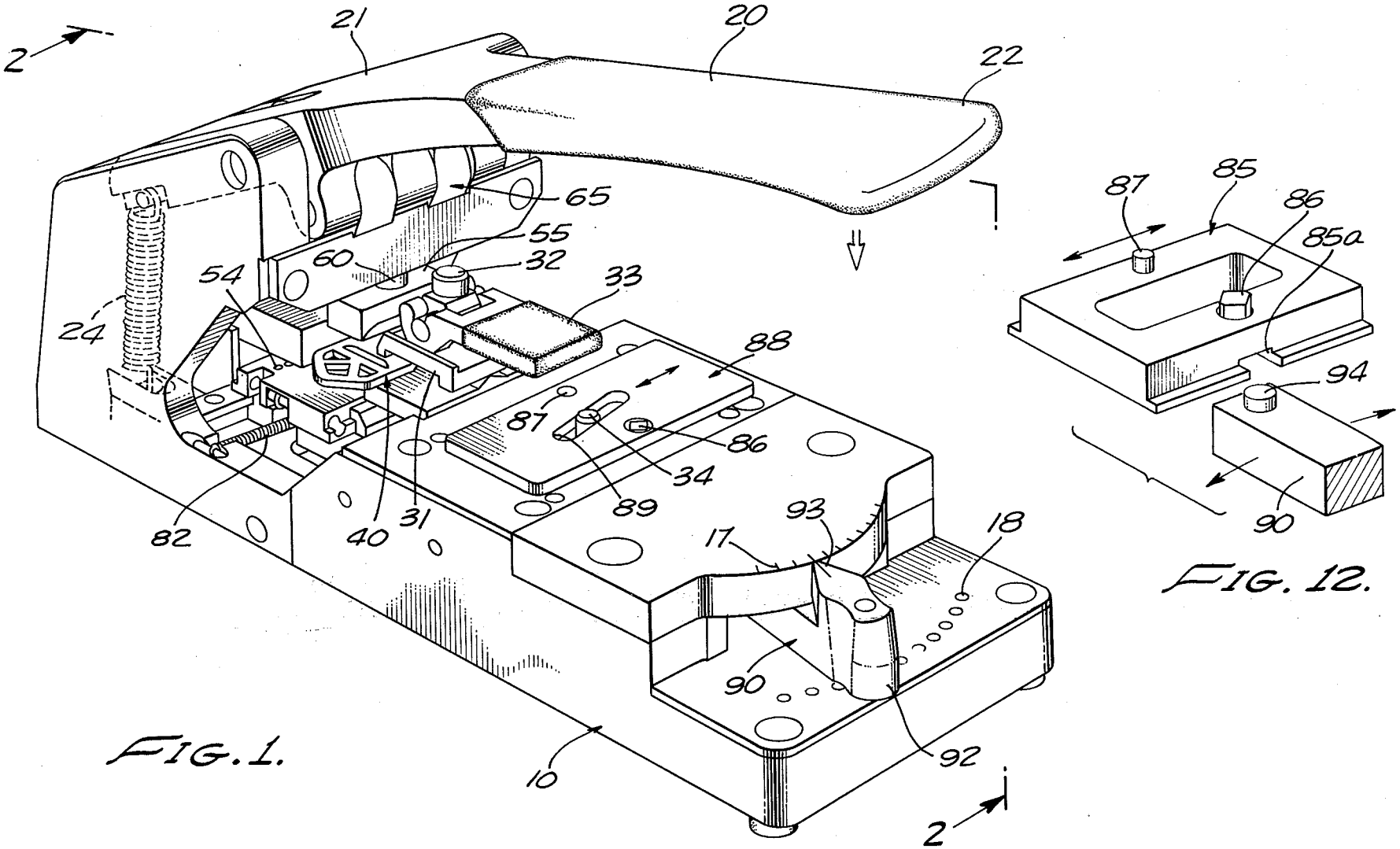
FIG. 1 is a perspective view of my new key cutting machine.
FIG. 12 is a perspective view of the depth cam carriage.

Reference is now made to the drawings and to FIGS. 1 through 10, inclusive, and 12 illustrating the presently preferred form of the invention.

The machine has an elongated base 10 and an elongated operating handle 20 which is disposed above the base in a generally parallel relationship thereto. The rearward end 21 of the operating handle is pivotally supported above the rearward end of the base upon a pivot shaft 23. The forward end 22 of the operating handle is disposed above the forward end of the base. Forward end 22 of the operating handle is normally somewhat elevated, and is held in that position by means of a pair of return springs 24 which couple the rearward extremity of the handle (to the rear of pivot shaft 23) to the rearward end of the base.

In general, the method of cutting a key is to first position a key blank in the machine according to a particular notch that is to be cut in the blank, and then the forward end 22 of the operating handle 20 is manually depressed in order to cause the desired notch to be cut in the key blank by means of a punch and die mechanism. Furthermore, as will be described, a feature of the invention is that the release of the operating handle, and its subsequent upward movement, causes a ratchet mechanism associated with the die carriage to be released so that the die carriage may be automatically advanced in a direction longitudinally of the key blank to the next notch location.

Figure 2:
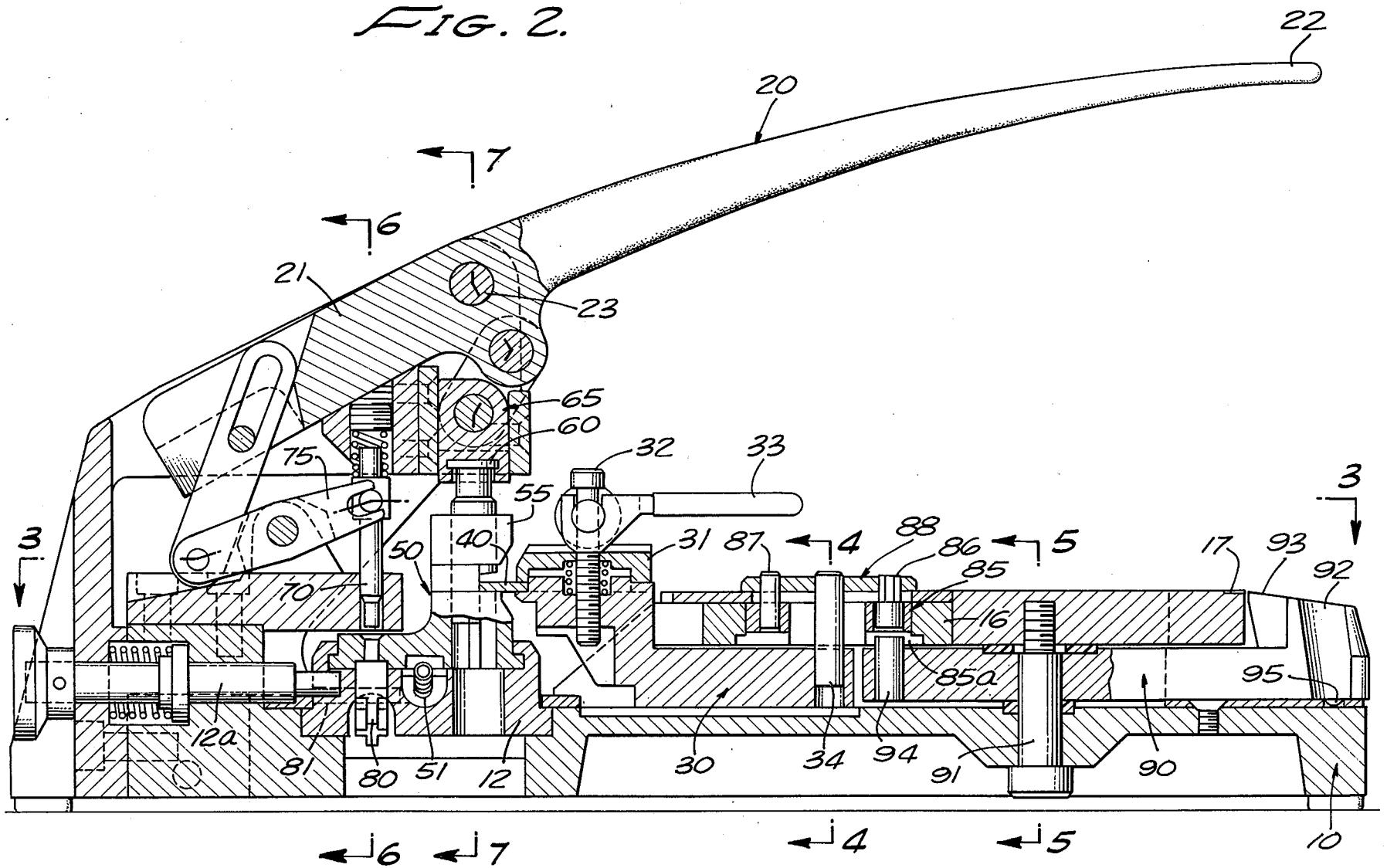
FIG. 2 is an elevational cross-sectional view of the machine taken on the line 2—2 of FIG. 1.

Thus there is provided on the base 10 a track 12 which extends transversely of the machine, and supports a die carriage 50 in sliding relationship therewith so that the die carriage may reciprocate in a horizontal plane but transversely to the longitudinal axes of base 10 and operating handle 20. Track 12 is positioned directly below the pivot shaft 23, as best seen in FIG. 2.

Figure 4:
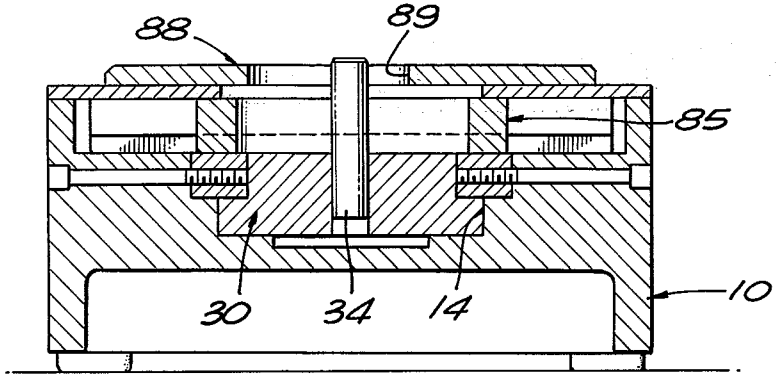
FIG. 4 is a transverse cross-sectional view taken on the line 4—4 of FIG. 2.

Also provided on the base 10 is a track 14 for supporting a key carriage 30. Key carriage 30 supports a key blank 40 (FIGS. 1, 2, and 9), and the key blank is disposed in a horizontal plane with its longitudinal axis extending transversely of the machine. Key carriage 30 is disposed forwardly of the die carriage 50. Key carriage 30 is also adapted for reciprocating movement in a horizontal plane, but this movement takes place lengthwise of the machine, so that the key blank 40 is moved either closer to or further away from the die carriage 50. Key carriage track 14 extends longitudinally of the machine (FIG. 4).

Figure 6:
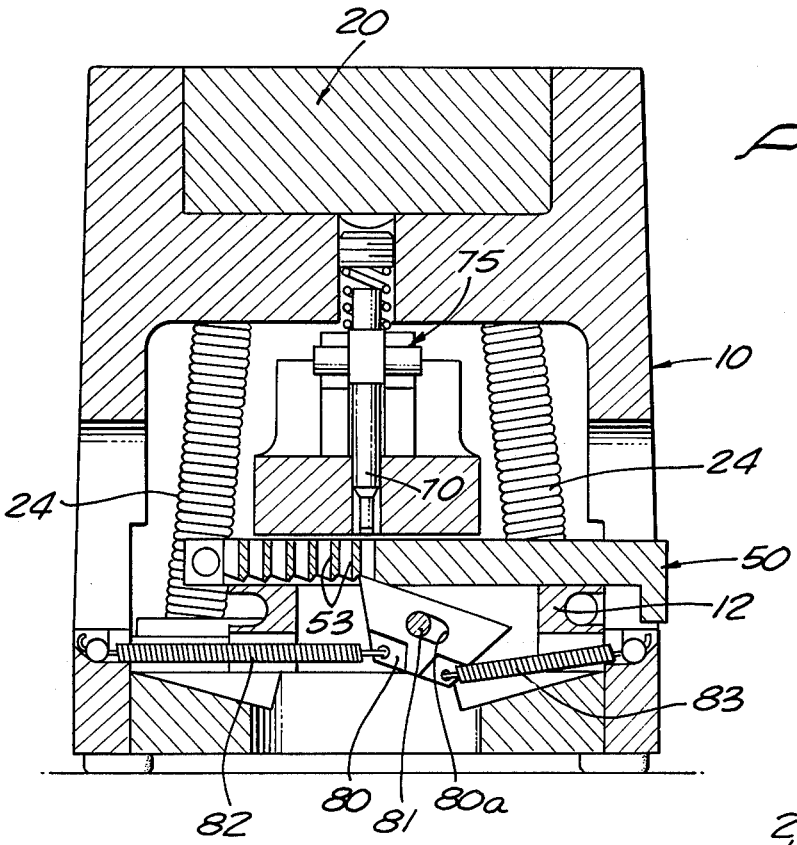
FIG. 6 is a transverse cross-sectional view taken on the line 6—6 of FIG. 2.
Figure 7:
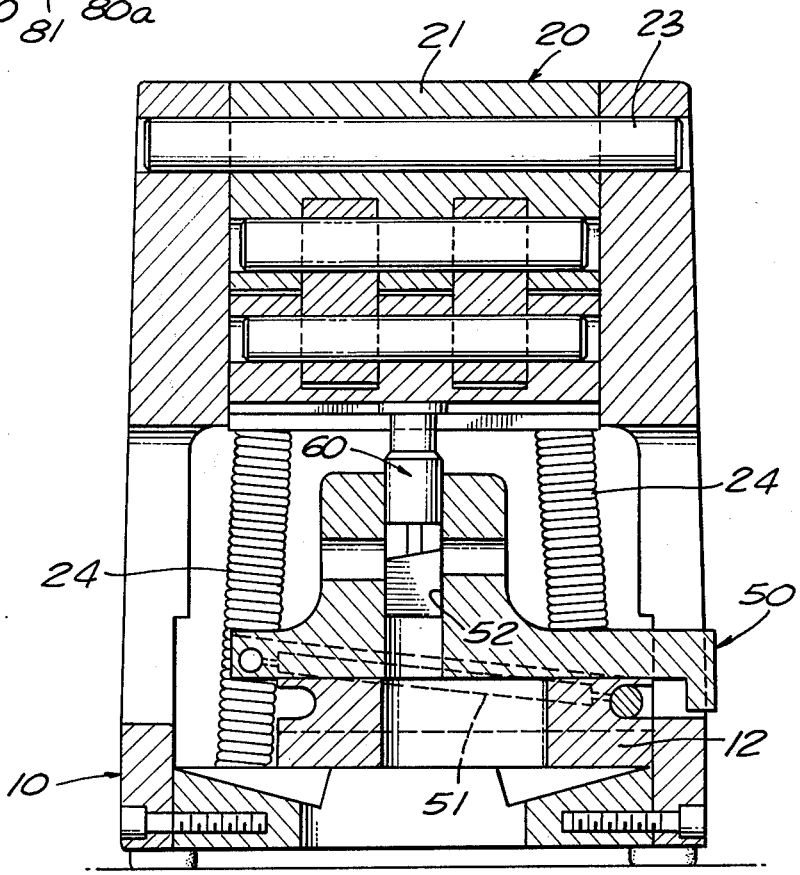
FIG. 7 is a transverse cross-sectional view taken on line 7—7 of FIG. 2.
Figure 8:
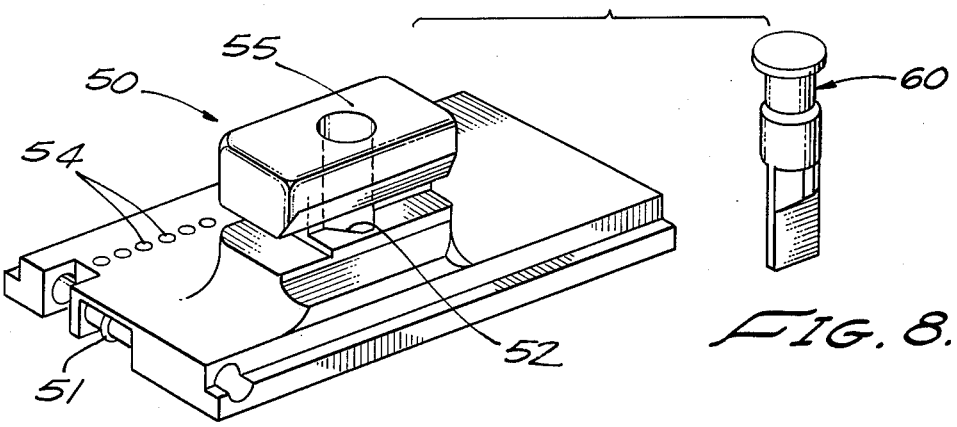
FIG. 8 is a perspective view of the die carriage and of the punch associated therewith.
Figure 9:
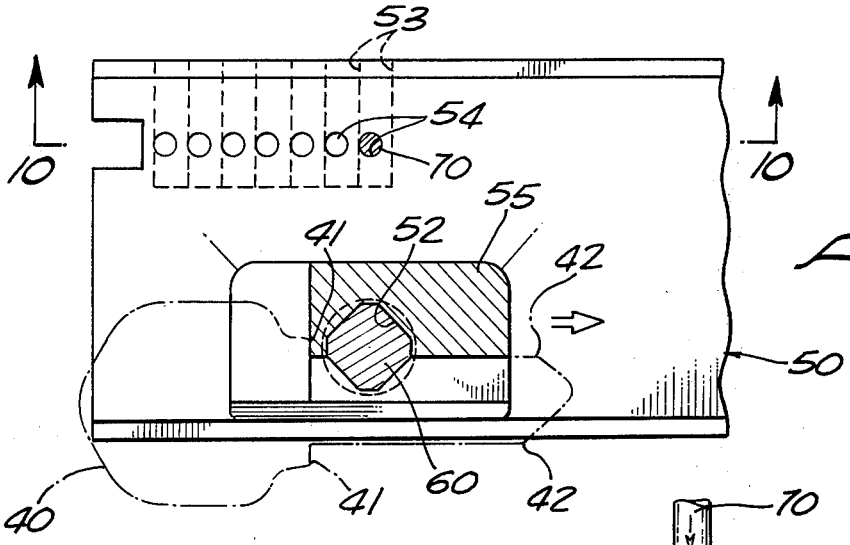
FIG. 9 is a top plan view of the die carriage partially in cross-section.

Die carriage 50 may move either from left to right or from right to left in its tract 12 depending upon whether the key blank is to be cut commencing from its shoulder 41 or from its tip end 42. Tract 12 (FIGS. 2 and 6) has two alternate positions, one at the left of the machine and one at the right of the machine, and a spring-loaded lock pin 12*a* (FIG. 2) is utilized to lock the track in its selected position. If the key blank is to be cut from left to right then the track 12 is placed in its right hand position as shown in FIG. 6. If the key blank is to be cut from right to left than the track is placed in its left hand position (not specifically shown).

The die carriage 50 includes a die 52 which is of suitable shape for the particular type of standard key that is to be cut. A punch 60 has a cutting end which is of the same shape. Die carriage 50 includes a raised portion 55 which serves as a vertical guideway for the punch 60, so that the punch 60 is reciprocable in a vertical direction relative to the die 52. Directly below the pivot shaft 23 and operated by downward movement of the operating handle 20 there is a punch drive mechanism 65 which serves to drive the punch 60 downward into and through the die 52.

Also associated with the die carriage 50 is a drive spring 51 (FIGS. 2 and 7) which pulls the die carriage 50 in the desired direction as the cutting of the successive notches on the key blank progresses. The structure of the die carriage 50 is illustrated in detail in FIGS. 6 through 10, inclusive. The undersurface of the die carriage is provided with a series of notches or ratchet grooves 53. These notches are utilized in conjunction with a ratchet mechanism, now to be described, for controlling the automatic advance action of the die carriage.

Figure 10:
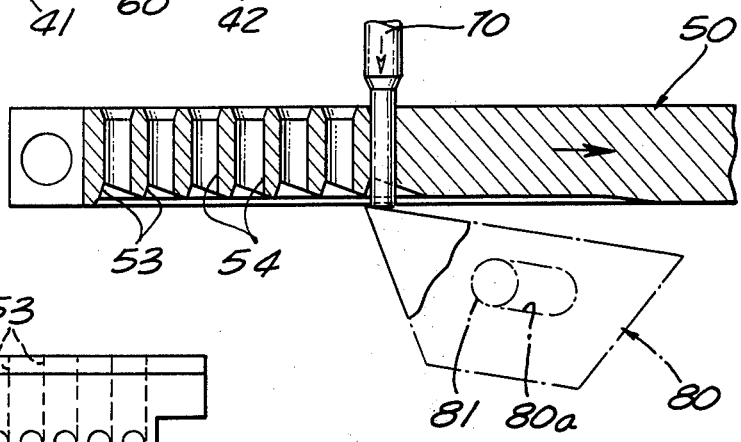
FIG. 10 is a longitudinal cross-sectional view of the die carriage taken on the line 10—10 of FIG. 9.

The ratchet mechanism includes a ratchet plate 80, FIGS. 6 and 10, which has a trapezoidal configuration. Ratchet plate 80 is disposed in a vertical plane extending transversely of the machine. The long side of the trapezoid is disposed upward while the short side is disposed downward. Ratchet plate 80 also has a horizontally elongated central opening 80*a*. A ratchet pin 81 is an integral part of the die carriage track 12, and extends through the central opening 80*a*. A pair of identical springs 82 and 83 are fastened to the lower corners of the ratchet plate 80, and each of these springs has its remaining end secured to the corresponding lateral edge of the base 10 as shown in FIG. 6. The positioning of track 12 at either the extreme left or the extreme right of the machine base, however, has the effect of causing one of the springs to be relatively short while the other is relatively long. Thus as shown in FIG. 6 the spring 82 on the left side of the machine is relatively long while spring 83 on the right side of the machine is relatively short.

The ratchet mechanism operates as follows. The relatively long spring pulls the associated upper end of the ratchet plate 80 upward, as shown in FIG. 6. The raised corner of the ratchet plate therefore engages a notch 53 on the undersurface of die carriage 50. When the ratchet plate is depressed the drive spring 51 causes die carriage 50 to advance, and the ratchet plate then pops upward to engage the next succeeding one of the notches 53, thus stopping the die carriage at the next succeeding notch position for the key blank.

According to my invention a separate mechanism is provided for precisely locating each of the notch positions where a cut is to be made. Thus the die carriage 50 has a series of locator holes 54, each of which is associated with, and communicates with, a corresponding one of the notches 53. Each locator hole 54 extends vertically through the die carriage 50, and each has a conical enlargement in its upper end portion. A locator pin 70 (FIGS. 2, 6, and 10) is supported from the operating handle 20 somewhat to the rear of the punch drive mechanism 65. A locator pin drive mechanism 75 (FIG. 2) couples operating handle to the locator pin 70. This drive mechanism is so designed as to move the locator pin 70 in a downward direction far more rapidly than the punch 60 is moved. Consequently, the locator pin 70 engages one of the locator holes 54, and thus precisely positions the die carriage 50, prior to the engagement of punch 60 with the material of the key blank 40 supported upon the die 52.

Locator pin 70 is not only utilized to achieve a precise position of the die carriage and hence of the longitudinal position of the notch on the key blank, but it also provides an essential portion of the automatic operation of the advance mechanism and its associated ratchet mechanism. Specifically, as the locator pin 70 progresses downward through a locator hole 54 its lowermost end strikes the upper corner of the ratchet plate 80, causing the ratchet plate 80 to lose its engagement with the associated notch 53. This action is illustrated in FIG. 10 of the drawings. Thus as operating handle 20 is released by the operator and is caused to return upward to its normal position by the return springs 24, the upper corner of ratchet plate 80 becomes engaged with the next succeeding one of the notches 53 before the locator pin 70 is fully withdrawn from its engagement with the ratchet plate. Drive spring 51, therefore, advances die carriage 50 to the next notch location.

Key carriage 30 includes a clamp 31 for holding key blank 40 in place. A clamp handle 33 rotates on a clamp bolt 32 for depressing the key clamp 31 against the key blank. Thus the key blank is held securely in place while the machine performs its cutting action, and then the handle 33 is manually rotated upward so as to release the newly cut key from the key carriage.

Also forming a part of key carriage 30 is a drive pin 34 (FIG. 2) which is utilized for adjusting the position of the key carriage in a direction longitudinally of the machine, so as to thereby adjust the depth of each notch that is cut by the punch 60. Drive pin 34, and hence key carriage 30 and key blank 40, is caused to move either towards or away from the die carriage 50, by means of a depth setting mechanism now to be described.

Figure 3:
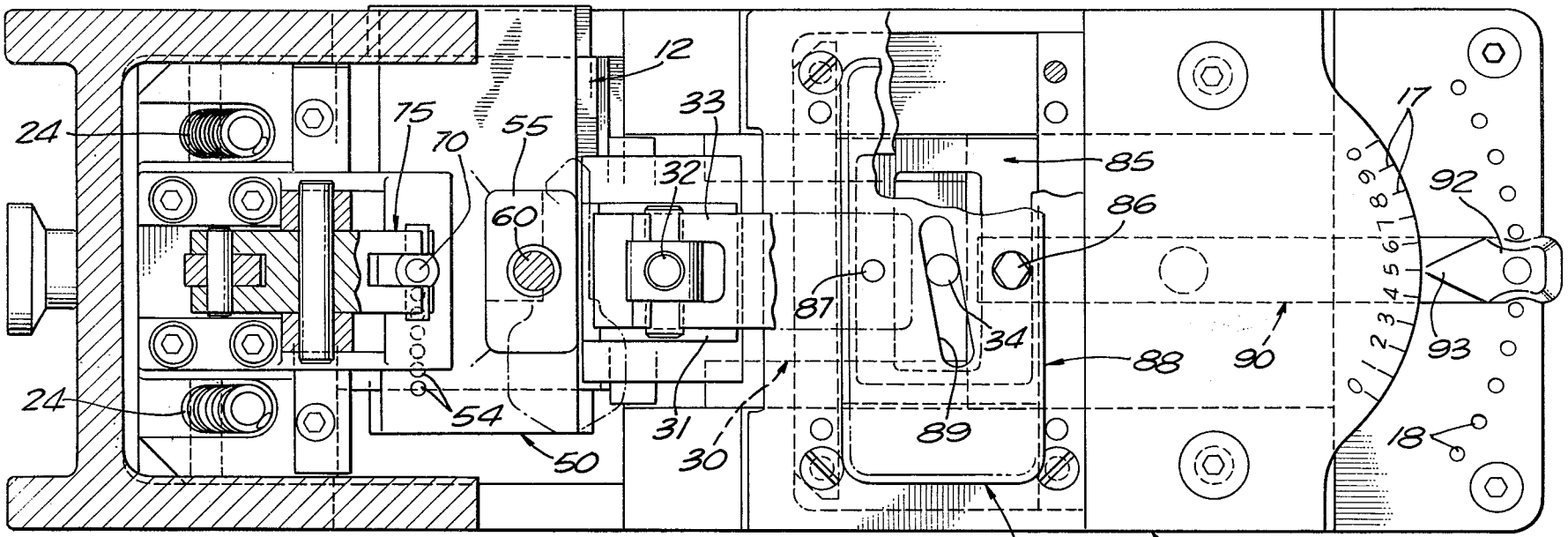
FIG. 3 is a plan view partially in cross-section, taken on line 3—3 of FIG. 2.
Figure 5:
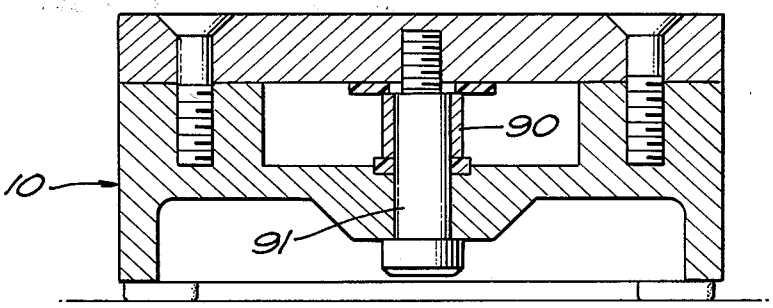
FIG. 5 is a transverse cross-sectional view taken on the line 5—5 of FIG. 2.

Machine base 10 also includes a track 16 for a cam carriage 85. Track 16 (FIG. 2) permits the cam carriage 85 (FIG. 12) to move laterally of the machine base 10. Cam carriage 85 has a forward cam lock pin 86 and a rearward cam lock pin 87. A cam plate 88 (FIGS. 1 and 2) is placed upon the cam carriage and held in position there by means of the lock pins. Cam plate 88 has a cam slot 89 which is best seen in FIG. 3.

A depth control lever 90 extends longitudinally of the base 10 and is disposed in a horizontal recess in the forward end of the base. A pivot pin 91 extends vertically upward through the base 10 (FIG. 2) and through a corresponding opening in the depth lever 90, to provide a vertical axis about which the depth lever rotates. At its forward end the depth lever 90 has an upwardly projecting drive pin 94 which engages a longitudinal slot 85*a* in the cam carriage 85 (FIG. 1). Pivoting action of the depth lever 90 about the vertical axis of pin 91 produces transverse movement of the cam carriage 85, and drive pin 34 of the key carriage 30 which is received in the cam slot 89 then produces a corresponding longitudinal movement of the key carriage.

As its rearward end the depth lever 90 has a handle 92 above which there is a pointer 93. An arcuate scale 17 formed on the upwardly facing surface of base 10 cooperates with pointer 93 to indicate the depth setting of the key carriage 30. At the same time a spring loaded ball 95 provided on the underside of handle 92 (FIG. 2) cooperates with a corresponding series of dimples or indexing holes 18 in order to lock the depth lever 90 in its selected position.

Figure 11:
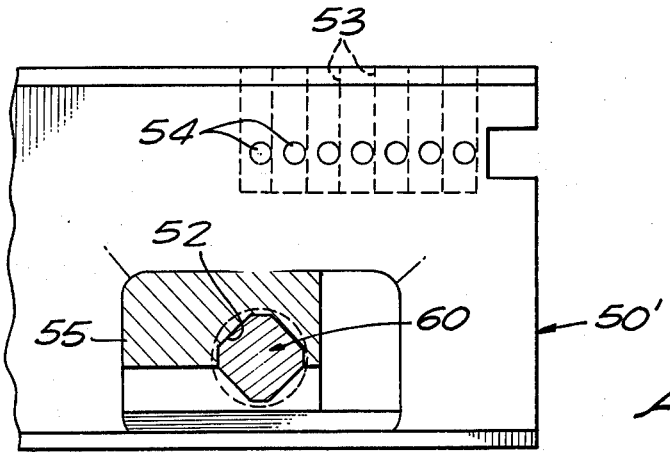
FIG. 11 is a plan view of an alternate form of the die carriage.

FIG. 11 illustrates an alternate form of die carriage 50' which has its locating holes and ratchet notches on the other end, and is hence designed to move in the opposite direction and cooperate with ratchet plate 80 when having its right hand end held in a raised position.

While a particular embodiment of the invention has been described in complete detail in order to comply with the disclosure requirements of the patent laws, it will nevertheless be understood that the breadth and scope of the invention are to be limited only in accordance with the following claims:

What is claimed is:

1. A key cutting machine comprising:

a key carriage adapted to support a key blank thereon with the operative edge of the key blank projecting beyond the carriage;

a die carriage having a die and a punch supported thereon, said punch being reciprocable within said die;

means supporting said key carriage in juxtaposition to said die carriage so that the operative edge of the key blank may be interposed between said punch and said die;

means for adjusting the position of said die carriage relative to said key carriage in a direction longitudinally of the key blank, so as to select a longitudinal position on the key blank at which a notch is to be cut;

means for adjusting the position of said key carriage relative to said die carriage in a direction perpendicular to the operative edge of the key blank in order to select the depth of the notch that is to be cut; and means manually operable after both of said carriages have been positioned for driving said punch into said die to cut the notch;

wherein said die carriage has a series of notches spaced along one surface thereof in a direction parallel to the longitudinal axis of the key blank;

and which further includes ratchet means cooperating with said notches, and driving spring means associated with said die carriage for advancing same through a series of positions in which respective ones of said carriage notches correspond with respective notch locations on the key blank.

2. A key cutting machine as claimed in claim 1 which further includes a plurality of locator holes formed in said die carriage, one associated with each of said die carriage notches; and which further includes a locating pin associated with said punch drive means and which is adapted to engage the corresponding locating hole prior to the time when said punch engages the key blank.

3. A key cutting machine as claimed in claim 2 wherein said punch drive means includes an operating handle; and which is characterized by the fact that said locating pin travels faster than said punch so that said die carriage is precisely located at the desired key notch location before said punch engages the material of the key blank.

4. A key cutting machine as claimed in claim 3 which further includes spring means normally holding said operating handle in its unoperated position, and means for releasing said ratchet means each time said operating handle returns to its unoperated position.

5. A key cuttine machine comprising:

a key carriage adapted to support a key blank thereon with the operative edge of the key blank projecting beyond the carriage;

a die carriage having a die and a punch supported thereon, said punch being reciprocable within said die;

means supporting said key carriage in juxtaposition to said die carriage so that the operative edge of the key blank may be interposed between said punch and said die;

means for adjusting the position of said die carriage relative to said key carriage in a direction longitudinally of the key blank, so as to select a longitudinal position on the key blank at which a notch is to be cut;

means for adjusting the position of said key carriage relative to said die carriage in a direction perpendicular to the operative edge of the key blank in order to select the depth of the notch that is to be cut; and means manually operable after both of said carriages have been positioned for driving said punch into said die to cut the notch;

wherein said die carriage is removable, and said die carriage adjusting means includes a series of notches formed integral with said die carriage.

6. In a key cutting machine having a movable die carriage and a movable key carriage, the key carriage being movable towards or away from the die carriage in order to select the depth at which a notch is to be cut in the side of the key, while the die carriage is movable in a direction perpendicular to the direction of movement of the key carriage in order to permit the selection of a longitudinal position on the key blank at which a notch is to be cut, the improvement comprising:

a die carriage having a series of notches spaced along one surface thereof in a direction parallel to the longitudinal axis of the key blank;

ratchet means cooperating with said notches; and drive spring means associated with said die carriage for advancing same through a series of positions in which respective ones of said carriage notches correspond with respective notch locations on the key blank.

7. A key cutting machine as claimed in claim 6 which further includes a plurality of locator holes formed in said die carriage, one associated with each of said die carriage notches;

a punch supported on said die carriage, and reciprocable therein;

manually operable means for driving said punch; and;

a locating pin associated with said punch drive means and which is adapted to engage the corresponding locating hole prior to the time when said punch engages the key blank.

8. A key cutting machine as claimed in claim 7 wherein said punch drive means includes an operating handle, and which is characterized by the fact that said locating pin travels faster than said punch so that said die carriage is precisely located at the desired key notch location before said punch engages the material of the key blank.

9. A key cutting machine as claimed in claim 8 which further includes spring means normally holding said operating handle in its unoperated position, and means for releasing said ratchet means each time said operating handle returns to its unoperated position.

10. A key cutting machine comprising a movable carriage, punch and die means operable in predetermined positions of said carriage, coarse and fine positioning means for said carriage, and manually operable punch actuating means, characterized in that each operation of said punch actuating means first causes said fine carriage position means to operate and thereafter causes said punch and die means to operate; said coarse carriage positioning means operating in response to the release of said punch actuating means.

11. In a key cutting machine, a movable carriage having punch and die means associated therewith, a springloaded punch actuating handle, a fine carriage positioning means responsive to the operation of said handle before the punch is actuated, and a coarse carriage positioning means responsive to the release of said handle for advancing the carriage to its next cutting location.

12. In a key cutting machine, key cutting means, means for moving a key blank relative to said cutting means, coarse and fine positioning means for positioning the cutting means and key blank relative to each other, and an actuating handle coupled to said fine positioning means, said cutting means, and said coarse positioning means for actuating same in that sequence in response to each single operation of said handle.

* * * * *